US005835112A

United States Patent [19]

Whitlock et al.

[11] Patent Number: 5,835,112

[45] Date of Patent: Nov. 10, 1998

[54] SEGMENTED ELECTRICAL DISTRIBUTION PLANE

[75] Inventors: John Perry Whitlock, Lebanon; George H. Corrigan, III, Corvallis, both of Oreg.

[73] Assignee: Hewlett-Packard Company, Palo Alto, Calif.

[21] Appl. No.: 726,574

[22] Filed: Oct. 8, 1996

[51] Int. Cl.[6] ..... B41J 2/14

[52] U.S. Cl. ..... 347/50; 347/49; 338/309

[58] Field of Search ..... 347/50, 49, 59, 347/58; 29/890.1; 338/309, 307

[56] References Cited

U.S. PATENT DOCUMENTS

| | | | |
|---|---|---|---|
| 593,175 | 4/1897 | Timm et al. | 347/50 |
| 2,662,957 | 12/1953 | Eisler | 338/308 |
| 3,452,314 | 6/1969 | Sapoff et al. | 338/309 |
| 3,578,420 | 5/1971 | Nishimura et al. | 338/308 |
| 3,864,825 | 2/1975 | Holmes | 29/621 |
| 4,933,471 | 6/1990 | Schroeder | 357/70 |
| 4,933,743 | 6/1990 | Thomas et al. | 357/71 |
| 5,041,191 | 8/1991 | Watson | 156/652 |
| 5,210,549 | 5/1993 | Takahashi | 29/890.1 |
| 5,369,381 | 11/1994 | Gamand | 333/161 |

*Primary Examiner*—Edgar S. Burr
*Assistant Examiner*—Anthony H. Nguyen
*Attorney, Agent, or Firm*—Kevin B. Sullivan

[57] ABSTRACT

An interconnect structure and method for forming the same for electrically connecting a main contact point with a plurality of use points. The interconnect structure includes a uniform high resistance layer. A low resistance layer is formed on the uniform high resistance layer. The low resistance layer defines first and second conductors extending between a main contact point and corresponding first and second use points. The first conductor has a corresponding conductor width that is, at least in part, based on a resistance between the first and second conductors.

23 Claims, 6 Drawing Sheets

SEGMENTED ELECTRICAL DISTRIBUTION PLANE

BACKGROUND OF THE INVENTION

The present invention relates to printheads for use in ink jet printing. More specifically, the present invention relates to a segmented electrical distribution structure for distributing electrical energy to the resistors on the printhead so that the power consumed in each of the resistors is equal or nearly equal.

An ink jet printer includes a pen in which small droplets of ink are formed and ejected towards a printing medium. Such pens include printheads with orifice plates having very small nozzles through which the ink droplets are ejected. Adjacent to the nozzles inside the printhead are ink chambers, where ink is stored prior to ejection. Ink is delivered to the ink chambers through ink channels that are in fluid communication with an ink supply. The ink supply may be contained in a reservoir part of the pen or in the case of off-axis printing, the ink supply may be spaced from the pen.

Ejection of an ink droplet through a nozzle may be accomplished by quickly heating a volume of ink within the adjacent ink chamber. Rapid expansion of ink vapor forces a portion of ink in the chamber through the nozzle in the form of a droplet. This process is called "firing". The ink in the chamber is heated with a heat transducer that is aligned adjacent to the nozzle. Typically, the heat transducer is a resistor, or piezoelectric transducer, but may comprise any substance or device capably of quickly heating the ink. Such printers are known as thermal ink jet printers.

Thin film resistors are typically used in printheads of thermal ink jet printers. In such a device, a resistive heating material is typically disposed on an electrically and thermally insulated substrate. Conventional fabrication techniques allow placement of a substantial number of resistors on a single printhead substrate.

A supply voltage is connected to each of the resistors by an electrical distribution structure. It is important that the power consumed in each of the resistors is identical or nearly identical to minimize drop volume variation between resistors. In addition, an imbalance in power consumption by the resistors produces greater thermal stresses in those resistors having higher power consumption. High thermal stresses in the resistor tends to lead to premature failure of the resistor thus reducing output image quality.

Drive circuitry is provided for selectively applying the supply voltage across selected resistors thereby firing the resistor. The driver circuitry typically makes use of matched transistors in an attempt to minimize variation in power consumption by the resistors. The electrical distribution structure typically includes a plurality of spaced conductors each having a common or main contact point and a plurality of use points. It is important that these electrical conductors be formed in such a way that the separation or spacing between conductors is minimized. These electrical conductors tend to limit the number of resistors which can be used in the printhead. Printheads having greater numbers of resistors tend to be capable of printing faster and/or having higher resolution than printheads having fewer resistors.

The electrical distribution structure should also be capable of providing uniform or matched resistance between the driver circuitry and the resistor. Because the power consumed in the resistor is directly related to the resistance of the conductive structure, any mismatch in resistance of the conductive structure will result in a mismatch in power consumption of the resistors. This mismatch in power consumption tends to result in non-uniform drop size as well as additional stresses on the resistors.

Another important aspect of the electrical distribution structure is that the structure should reduce capacitive coupling between conductors which can lead to voltage spikes at the resistor.

The method for forming the electrical distribution structure should be well suited to the manufacturing environment. This method should minimize the number of masking steps and etching steps. A reduction of the number of process steps required to form the printhead tends to reduce the number of process steps, reducing the time to manufacture as well as the cost of manufacturing. Furthermore, because each process step introduces new errors due to alignment and process variation, the greater number of process steps tends to produce a greater number of defects in manufacturing. Finally, reducing the number of etch steps tends to limit the amount of damage to underlayers thereby increasing the reliability of the printhead.

SUMMARY OF THE INVENTION

An interconnect structure for electrically connecting a main contact point with a plurality of use points. The interconnect structure includes a uniform high resistance layer. A low resistance layer is formed on the uniform high resistance layer. The low resistance layer defines first and second conductors extending between a main contact point and corresponding first and second use points. The first conductor has a corresponding conductor width that is, at least in part, based on a resistance between the first and second conductors.

In one preferred embodiment the interconnect structure includes a plurality of heating elements for vaporizing ink for ejecting ink droplets onto print media. The interconnect structure is connected between a pair of supply terminals and each of the plurality of heating elements. In this preferred embodiment the uniform high resistance layer is formed from tantalum and the low resistance layer is formed from gold.

Another aspect of the present invention is a method for forming a segmented electrical distribution structure. The method includes forming a low resistance layer on a uniform high resistance layer. The method includes forming a mask and etching to define a plurality of conductors within the low resistance layer. The plurality of conductors provide interconnects between a main contact point with a plurality of use points. The method further includes forming a mask and etching to define the uniform high resistance layer extending beneath the plurality of conductors.

In one preferred embodiment the method includes defining a plurality of heating elements for vaporizing ink for ejecting ink droplets onto print media. The interconnect structure is connected between a pair of supply terminals and each of the plurality of heating elements. In this preferred embodiment the uniform high resistance layer is formed from tantalum and the low resistance layer is formed from gold.

DETAILED DESCRIPTION OF THE PREFERRED EMBODIMENT

Figure 1:
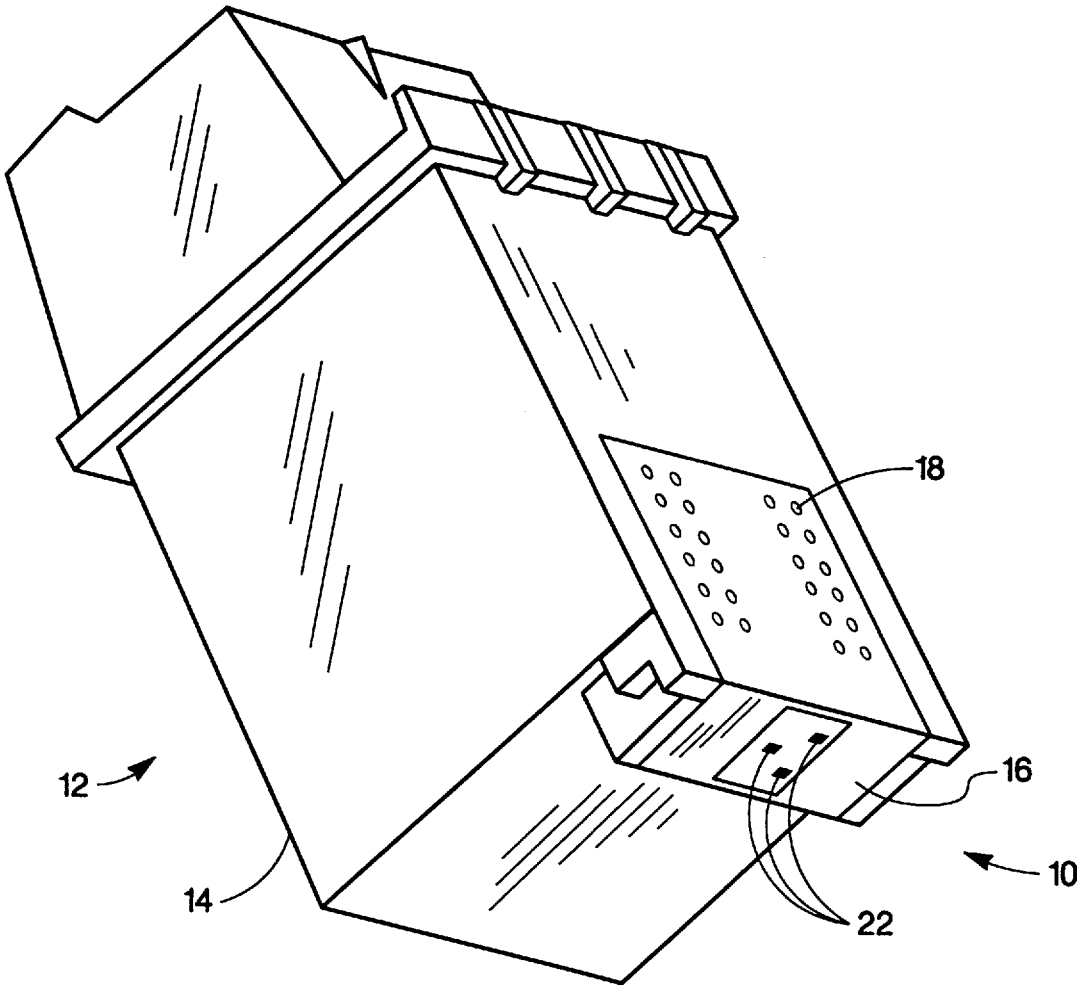
FIG. 1 is a perspective view of an ink jet printer pen that includes a printhead incorporating a preferred embodiment of the electrical distribution structure of the present invention.

FIG. 1 depicts a printhead 10 which includes an electrical distribution structure of the present invention carried by an ink jet pen 12. The preferred pen 12 includes a pen body which defines a reservoir 14. The reservoir 14 is configured to hold a quantity of ink. The printhead 10 is fit into the bottom 16 of the pen body and is controlled by electrical interconnects 18 for ejecting ink droplets from the printhead 10. The printhead 10 defines a set of nozzles 22 for expelling ink, in a controlled pattern, during printing. Each nozzle 22 is in fluid communication with a firing chamber (not shown) that is defined within the printhead 10.

The pen 12 includes an ink supply within the pen reservoir 14. Alternatively, the pen 12 may be configured for use with an "off-axis" ink supply which is spaced from the pen 12 and in fluid communication with the pen 12. Regardless of where the ink supply is located a supply conduit (not shown) conducts ink from the reservoir 14 to one or more ink channels (not shown) defined in the printhead 10. The ink channels are configured so that ink moving therethrough is in fluid communication with each firing chamber and hence each nozzle 22.

Conductive drive lines (not shown), connecting the printhead 10 to a plurality of electrical interconnects 18, are mounted to the exterior of the pen 12. The electrical interconnects 18 engage corresponding electrical interconnects which are carried on a printer carriage (not shown) thereby allowing the printer to selectively control the ejection of ink droplets as the pen 12 is moved relative to print media.

Figure 2:
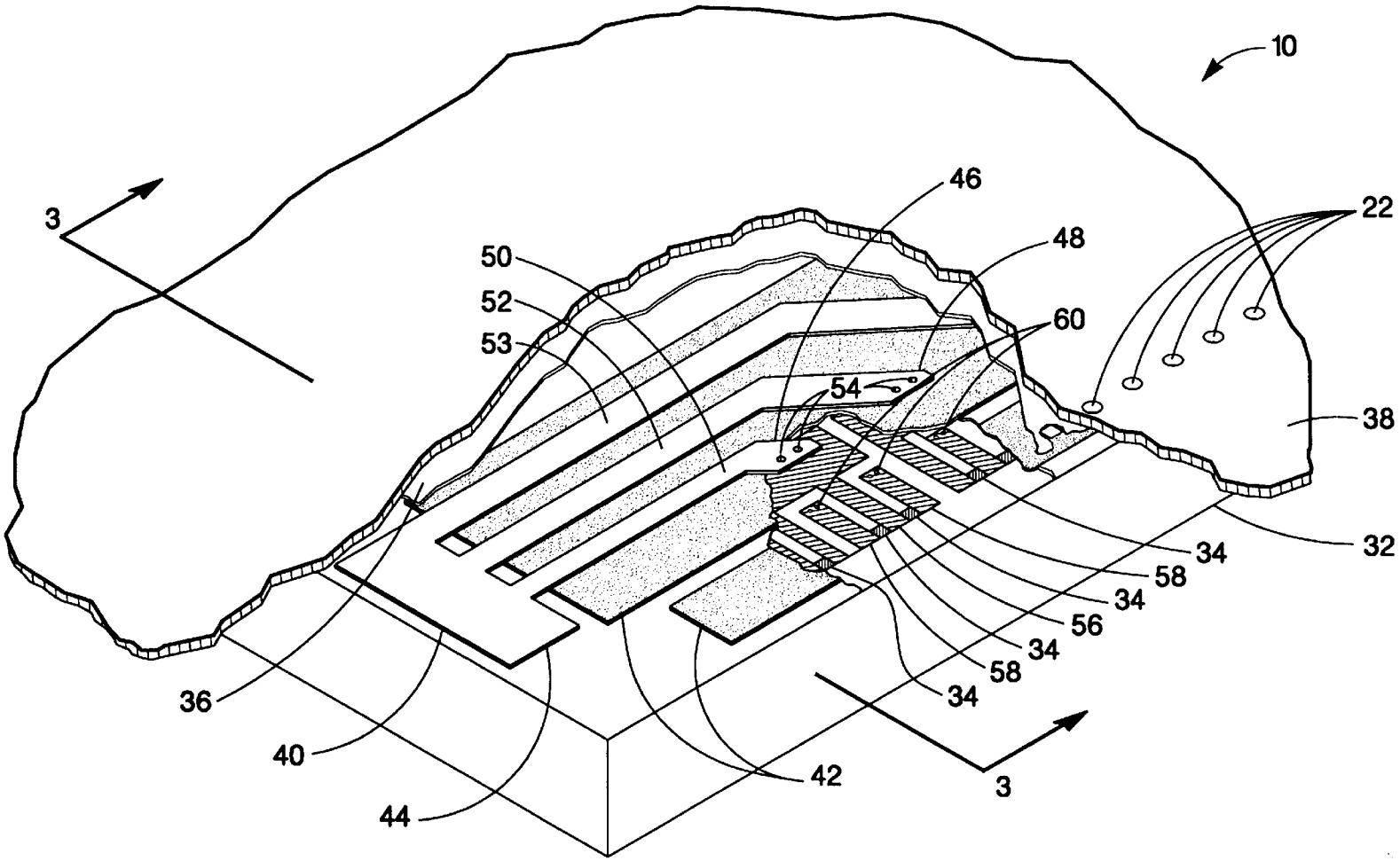
FIG. 2 is a printhead shown partially broken away in perspective to illustrate a preferred embodiment of the electrical distribution structure of the present invention.

FIG. 2 depicts a perspective view of the printhead 10 shown partially broken away to illustrate an electrical distribution structure 30 of the present invention. The printhead 10 includes a die or substrate 32 upon which the printhead 10 is formed. The die is formed from a suitable material such as silicon, ceramic, or metal, to name a few. A plurality of resistors 34 which vaporize ink when heated are formed on the die 32. A barrier material 36 together with an orifice layer 38 define ink chambers which are located proximate the resistors 34. The orifice layer 38 includes orifices or nozzles 22 which are formed in the orifice layer 38. By selectively energizing the resistors 34 ink is vaporized within the ink chamber which produces the expulsion of remaining ink within the chamber out through the nozzles 22. Ink ejected from the nozzles 22 forms droplets which form images on print media.

It is the electrical distribution structure 30 which is the subject of the present invention. The electrical distribution structure 30 includes a low resistivity material 40 which is formed on top of a high resistivity material 42. The low resistivity material 40 includes a main contact point 44 and individual use points 46 and 48, spaced from the main contact point 44. Extending between the main contact point 44 and the individual use points 46 and 48 are individual conductors 50 and 52, respectively. A conductor 53 is connected between the main contact point 44 and an individual use point that is not shown. The electrical distribution structure 30 of the present invention provides electrical connection between the main contact point 44 and individual use points 46 and 48 for maintaining an electric potential at each of the individual use point 46 and 48 at or nearly at an electric potential of the main contact point 44.

The individual use points 46 and 48 are connected to individual resistors 34 by vias 54 and conductor 56. Vias 54 are provided at each of the use points 46 and 48 for electrically connecting the low resistivity material 40 with the conductor 56 which is formed in a layer below the high resistivity layer 42. The conductor 56 is preferably formed of a first layer of a mixture of tantalum and aluminum and a second layer of aluminum. The conductor 56 forms an electrical connection between the low resistance layer 40 and a first side of resistor 34. A separate conductor 58 is connected to the other side of resistor 34 as well as via 60. The via 60 and conductor 58 provides electrical connection to a switching device such as a transistor (not shown) which is used to selectively connect the second terminal of the resistor 34 to a first electric potential source.

In the preferred embodiment shown in FIG. 2 the first electric potential source is a ground potential. The low resistivity material 40 is connected to a second electric potential source, different from the first electric potential source, such that activation of the switching devices (not shown) produces a current through the resistor 34. This electric current through resistor 34 produces heat which is used to vaporize ink in the ink chambers for ejecting ink droplets from nozzles 22. The switching devices are selectively activated by the electrical interconnects 18 shown in FIG. 1 for controlling the expulsion of ink from each of the nozzles 22.

It is crucial that the power consumption in each of the resistors 34 is balanced or nearly balanced for each of the resistors 34 to minimize drop volume variation as well as prevent premature failure of resistors 34. The electrical distribution structure 30 of the present invention, among other things, provides a plane of equal potential while matching resistance between the main contact point 44 and the use points 46 and 48. This resistive matching takes into consideration the sheet resistance of the low resistivity material 40 as well as the resistance between adjacent conductors.

For example, the sheet resistance of the low resistivity material 40 for a given conductor width produces an increasing resistance the farther the use point 46, 48 is from the main contact point 44. Therefore, to maintain an equal potential plane, the farther the use point 46, 48 is from the main contact point 44, the greater the width of the conductive trace should be. Because the use point 48 is farther from the main contact point 44 than the use point 46 the conductor 52 must be wider than the conductor 50 to compensate for this additional sheet resistance. Alternatively, the sheet resistance of the low resistivity material 40 may be compensated for by increasing the thickness of conductive trace 52.

Another factor which the electrical distribution structure 30 of the present invention compensates for is the electrical interaction between adjacent conductors which extend from the main contact point 44 and individual use points 46 and 48. Because the high resistivity material 42 beneath the low resistivity material 40 provides an electrical connection between adjacent conductors which effects the electric potential at each of the use points 46 and 48. This resistive coupling between the electrical conductors 50 and 52 tends to reduce the effect of sheet resistance of the low resistivity material 40 previously discussed. By compensating for both the sheet resistance of the low resistivity material 40 and the resistive interaction between adjacent electrical conductors 50 and 52 extending between the main contact point 44 and individual use points 46 and 48 the electric potentials that these use points 46 and 48 can more closely balanced thereby minimizing variations in power consumption of the resistors 34.

In the preferred embodiment the high resistivity material 42 is a uniform layer of tantalum. In this preferred embodiment the low resistivity material 40 is formed from a gold layer. In this preferred embodiment the gold layer is of uniform thickness and the width of the conductors 50 and 52 between the main contact point 44 and the individual use points 46 and 48 is varied to compensate for both sheet resistance of the gold layer and the resistance between adjacent conductors extending between the main contact point 44 and individual use points 46 and 48. For example, the width of conductor 52 between the main contact point 44 and the individual use point 48 is selected to compensate for each of the sheet resistance of the gold conductor 52, the resistance between the gold conductor 52 and the gold conductor 50 and the resistance between the gold conductor 52 and the gold conductor 53. By compensating for these resistances by varying the width of conductor 52 the electric potential at each of the individual use points can be made the same or nearly the same thereby minimizing power dissipation imbalances in the resistors 34.

FIG. 2 is a representation to illustrate the interconnection of the electrical distribution structure 30 of the present invention with the printhead 10. This figure is not drawn to scale and does not show all of the layers used to form the printhead 10. For example, each of the layers shown except for the low resistivity layer 40 and high resistivity layer 42 are separated by a passivation layer such as a silicon nitride layer or silicon carbide layer which is not shown in FIG. 2.

Figure 3:
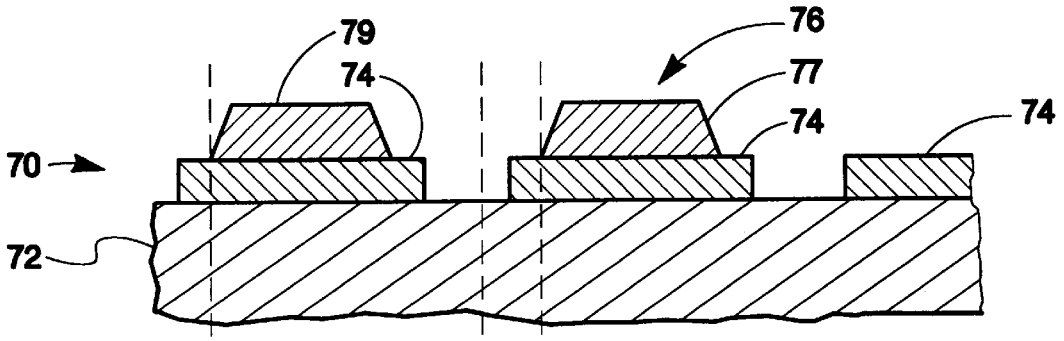
FIG. 3 is a cross-sectional diagram, taken through line 3—3 of FIG. 2, depicting a previously used electrical distribution structure.

FIG. 3 depicts a previously used electrical distribution structure 70. The electrical distribution structure 70 includes a silicon carbide passivation layer 72 having a tantalum layer 74 deposited thereon. A gold layer 76 is deposited on the tantalum layers 74 to form conductors 77 and 79. The electrical distribution structure 70 is formed by depositing the tantalum layer 74 on the silicon carbide passivation layer 72 using a sputtering technique. The gold layer 76 is then deposited on the tantalum layer 74 using a sputtering deposition method. A mask is patterned on the gold layer 76 to define the final tantalum layer 74. A wet etch is used to etch the gold layer 76. The wet etch in the preferred embodiment for etching the gold layer 76 is a mixture of $HNO_3$, $H_2O$ and Hydrochloric acid (HCL) in a 3:3:1 ratio. A second wet etch process is performed to etch the tantalum layer 74. In the preferred embodiment the wet etch used to etch the tantalum layer 74 is a mixture of Acetic acid, $HNO_3$, and Hydroflouric acid (HF) in a 30:1:5 ratio. The gold layer 76 is then re-etched to remove over hang resulting from the undercut of the tantalum layer 74 beneath the gold layer 76. A mask is formed on the gold layer 76 to define the final gold patterning. The gold layer 76 is then re-etched with a wet chemical etch to define the conductors 77 and 79 in the gold layer 76. This re-etch process in the preferred embodiment is performed using a mixture of $HNO_3$, $H_2O$ and Hydrochloric acid (HCL) in a 3:3:1 ratio.

Figure 4:
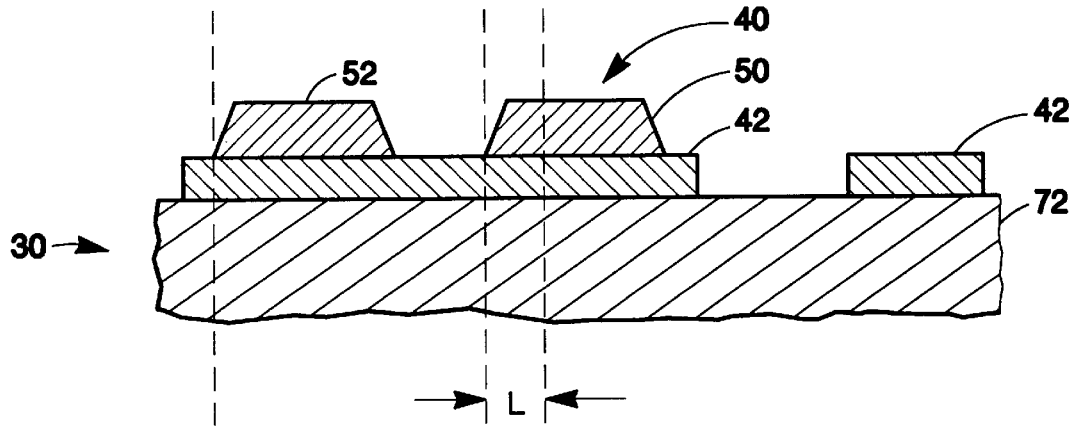
FIG. 4 is a cross-sectional diagram, taken through line 3—3 of FIG. 2, depicting a preferred embodiment of the electrical distribution structure of the present invention.

FIG. 4 shows the electrical distribution structure 30 of the present invention. The electrical distribution structure 30 includes a high resistivity material 42 having a low resistivity material 40, defining conductors 50 and 52, formed thereon. The high resistivity material 42 is preferably formed on a suitable passivation layer 72 such as silicon carbide. In the preferred embodiment the high resistivity layer 42 is tantalum and the low resistivity layer 40 is gold. It can be seen from FIG. 4 that the electrical distribution structure 30 of the present invention makes use of a continuous or uniform sheet of high resistivity material 42 upon which the high conductivity material 40 is defined. In contrast to the use of singulated layers of tantalum shown in FIG. 3, the present invention shown in FIG. 4 makes use of a uniform or continuous layer 42 of tantalum beneath the conductors 50 and 52. The electrical distribution structure 30 of the present invention has both electrical advantages as well as advantages in the process for forming the electrical distribution structure 30.

It can be seen from FIG. 4 that adjacent conductors 50 and 52 in the electrical distribution structure 30 of the present invention can be placed closer together by a distance L than the adjacent electrical conductors 77 and 79 of the previously used electrical distribution structure 70. By allowing the electrical conductors 50 and 52 to be placed closer together in the electrical distribution structure 30 of the present invention, more electrical conductors 50 and 52 can be placed on a given sized die than in the previously used distribution structure 70 shown in FIG. 3. The spacing or pitch between adjacent conductors 77 and 79 shown in FIG. 3 are determined by the processing steps to define the singulated tantalum layer 74 and the gold conductors 77 and 79. Because tantalum layer 74 and gold layer 76 are defined in two separate making and etching steps, the spacing or ground rule requirements effectively add requiring greater separation of the conductors 77 and 79 than required by the method of forming electrical conductors 50 and 52 in the electrical distribution structure 30 shown in FIG. 4 of the present invention. The conductors 50 and 52 of electrical distribution structure 30 of the present invention are formed using a single masking and etching step thereby requiring less spacing for ground rule requirements between the conductors 50 and 52. The method for forming the electrical distribution structure 30 of the present invention will now be described with respect to FIGS. 5*a*–5*g*.

Figure 5A:
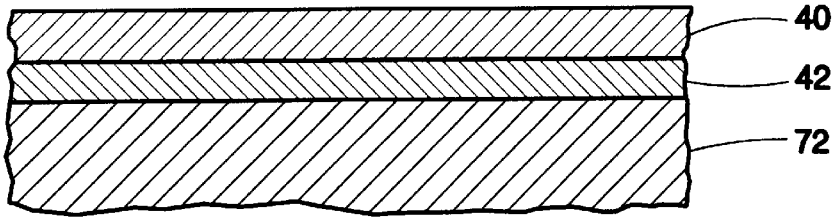
FIGS. 5A–5G are cross-sectional diagrams, taken through line 3—3 of FIG. 2, depicting fabrication of a preferred embodiment of the electrical distribution structure of the present invention.
Figure 5B:
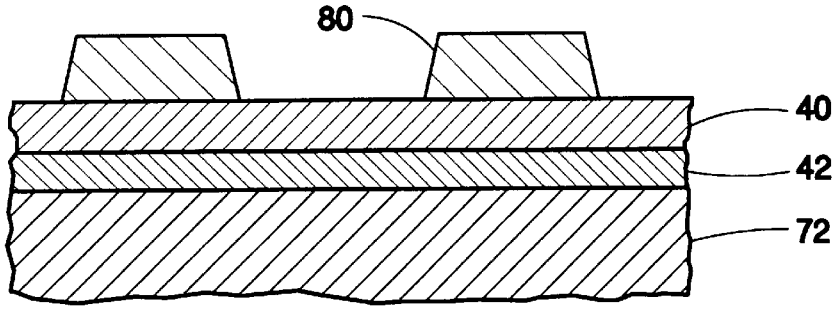

FIGS. 5*a*–5*g* illustrate the method for forming the preferred electrical distribution structure 30 shown in FIG. 4. The tantalum layer 42 having a thickness of 6000 angstroms is first deposited on the passivation layer 72. In the preferred embodiment the passivation layer 72 is formed from silicon nitride or silicon carbide. The gold layer 40 having a thickness of 6000 angstroms is then deposited on the tantalum layer 42. A mask layer 80 shown in FIG 5*b* is defined on the low resistivity gold layer 40 for defining the final the gold layer shown in FIG. 5*g*. The mask layer 80 among other things defines the conductors 50 and 52. The mask layer 80 is a photoresist mask which is patterned using a photolithographic technique.

Figure 5C:
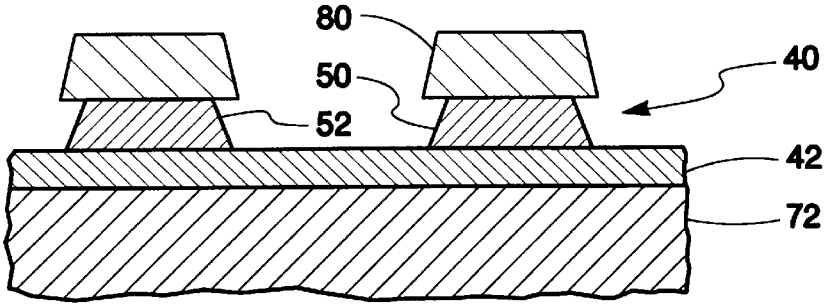
Figure 5D:
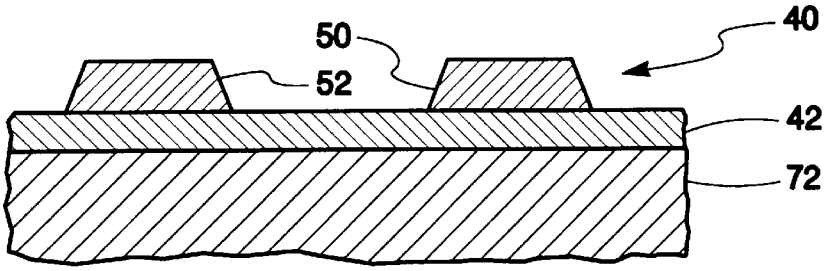
Figure 5E:
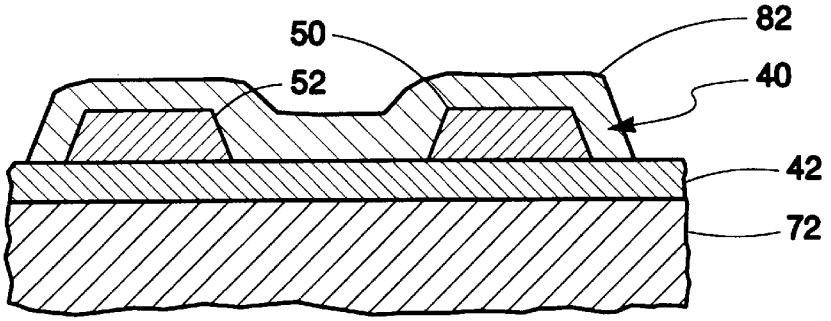
Figure 5F:
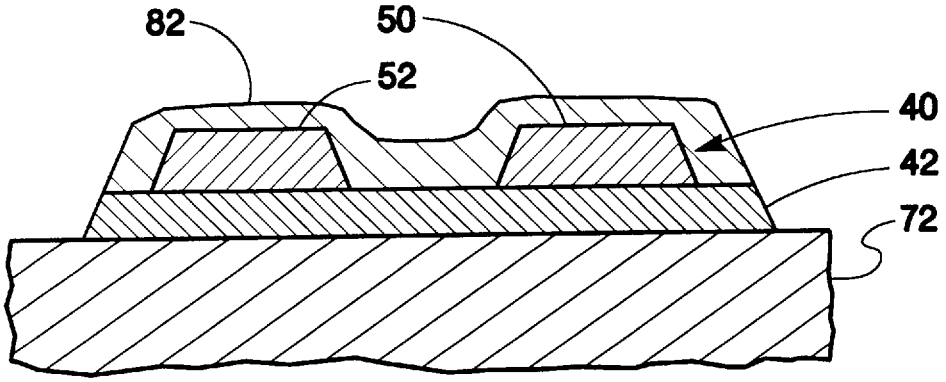
Figure 5G:
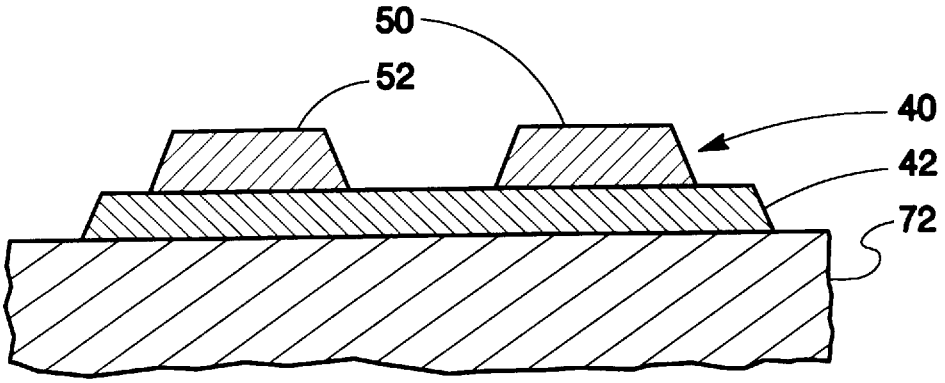

A wet etch is then used to etch portions of the gold layer 40 which are not covered by the photoresist mask 80 as shown FIG. 5*c*. In the preferred embodiment, the wet etch is a mixture of nitric acid, Deionized water (DI) and hydrochloric acid in a 3:3:1 ratio. The photoresist mask 80 is then removed as shown in FIG. 5*d*. A second photoresist mask 82 is then applied over the gold and tantalum layers 40 and 42. This second photoresist mask 82 is patterned to define the final tantalum layer 42 using a photolithographic technique as shown in FIG. 5*e*. A dry etch process such as a chlorine plasma etch process is then used to remove portions of the tantalum layer 42 that are not covered by the photoresist mask 82 as shown in FIG. 5*f*. The resulting electrical distribution structure 30 of the present invention is shown in FIG. 5*g*.

It can be seen from FIGS. 5*a*–5*g* that the conductors 50 and 52 in the gold layer 40 are defined using a single masking step and require only the design rule spacing of this single masking step. In contrast, the previously used electrical interconnect 76 shown in FIG. 3 requires that the electrical interconnect 76 be spaced based on the design combined rules of both the tantalum masking and etching step as well as the gold masking and etching step. Thus, the electrical conductors 50 and 52 in the gold layer 40 of the present invention can be placed closer together than the conductors 77 and 79 of the previously used interconnect 70. This allows not only more electrical conductors to be placed on a given sized die, but also allows the electrical conductors in the gold layer 40 to be wider thus lowering the resistance and improving the performance of the circuit.

Figure 6:
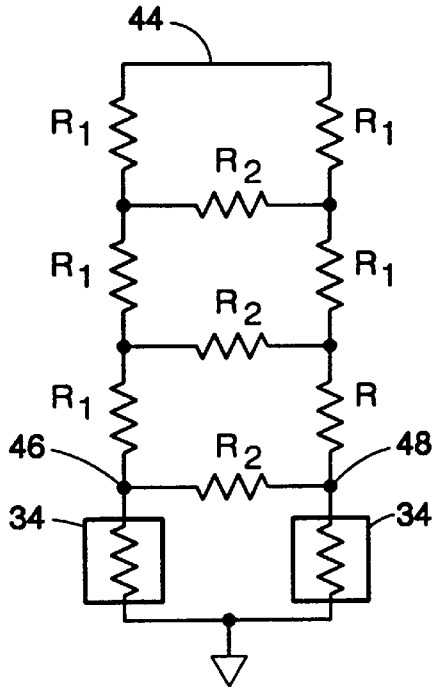
FIG. 6 is an equivalent circuit representing a pair of electrical conductors of the electrical distribution structure of the present invention, each connected to a resistor for illustrating load balancing.

FIG. 6 represents an electrical equivalent of the electrical distribution system 30 of the present invention shown in FIG. 2. The main contact point 44 is connected to a voltage supply and each of the use points 46 and 48 are connected to different resistors 34 which are connected to ground by switching devices. The resistances $R_1$ shown in FIG. 6 represent the sheet resistance of the conductors 50 and 52 extending between the main contact point 44 and the use points 46 and 48 respectively. The sheet resistance of the low resistivity material 40 or gold layer in the preferred embodiment is 0.020 ohms per square. The resistor $R_2$ represents the resistance between each of the conductors 50 and 52 through the tantalum layer 42. Because the sheet resistance of the tantalum is much greater than the sheet resistance of the gold, than the resistance $R_2$ will be much greater than the resistances $R_1$ which allows for a high frequency isolation between the gold lines. In addition, the resistance between the main contact point 44 and the use point 46 can be balanced with the resistance between the main contact point 44 and use point 48.

Figure 7:
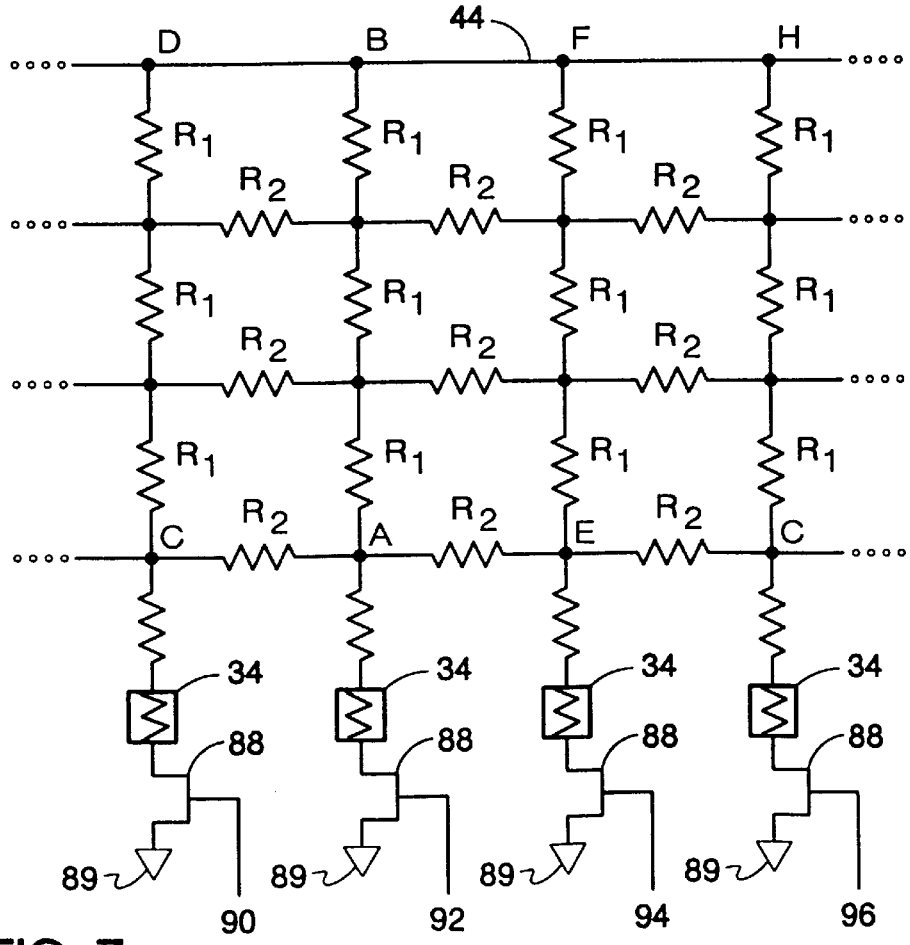
FIG. 7 is an electrical circuit modeling a plurality of electrical conductors of the electrical distribution structure of the present invention, each conductor connected between a main contact point and an individual use point which is connected to each of a plurality of resistors.

FIG. 7 represents an electrical equivalent of the electrical distribution system 30 of the present invention shown in FIG. 2 for a plurality of electrical conductors extending between the main contact point 44 and a plurality of use points with each of the use points being connected to a different resistors 34. The resistors $R_1$ represent a lumped model equivalent for the distributed sheet resistance of the low resistivity material 40 between the main contact point 44 and designated D, B, F and H and individual use points 46, 48 designated C, A, E and G. A resistor 34 is connected between each of the individual use points C, A, E and G and switching device 88. The switching device 88 is connected between each of the resistors 34 and a first supply terminal 89. Each of the switching devices 88 have a control terminal 90, 92, 94, and 96 for selectively switching the corresponding switching device 88 between a conducting mode and a non-conducting mode. In the preferred embodiment the switching devices 88 are MOS transistors and a supply voltage is connected across the main contact point 44 and the first supply terminal 89.

The above described lumped model will be used to compare the electrical distribution structure 30 of the present invention with a condition where no ground plane is used and a condition where a uniform ground plane is used. For each of these conditions the switching device 88 associated with use point A is in a conducting state and the switching devices 88 associated with use points C, E, and G are non-conducting state, simulating the firing or activation of a single resistor 34. A comparison can be done for the resistance $R_{AB}$ between the point designated B and the use point designated A for each of ground plane configurations or conditions.

For the condition where no ground plane is used then the conductors having sheet resistance $R_1$ are placed over an ideal insulator instead of the high resistivity material 42. An ideal insulator is modeled as if the conductors are electrically isolated from each other. For this condition, the resistors $R_2$ representing the distributed resistance of the ground plane can be modeled as an infinite resistance. The resistance between use point A and point B and the main contact point B designated $R_{AB}$ can be represented by the following equation:

$$\frac{1}{R_{AB}} = \frac{1}{3R_1} + 6\frac{1}{R_2 + 3R_1} + 6\frac{1}{2R_2 + 3R_1} + \ldots \qquad \text{Equation 1:}$$

where $R_1$ represents the distributed resistance of the low resistivity material 40 and $R_2$ is the resistance of the high resistivity material 42. For the condition where no ground plane is used the resistance $R_2$ in equation 1 is infinite yielding the following result shown in equation 2.

$$R_{AB}=(3)R_1: \qquad \text{Equation 2}$$

For the condition where a uniform low conductivity ground plane is used then the resistance $R_{AB}$ is modeled as a large sheet of high conductivity or low resistivity material. The resistance $R_2$ is the sheet resistance of the low resistivity ground plane is equal to the resistance $R_1$ of the low resistivity material 40 and equation 1 can be simplified as follows:

$$\frac{1}{R_{AB}} = \frac{1}{3R_1} + \frac{3}{2R_1} + \frac{6}{5R_1} \qquad \text{Equation 3:}$$

where equation can be simplified as shown in equation 4.

$$R_{AB}=(0.33)R_1: \qquad \text{Equation 4}$$

Finally, the case where conductors are formed using a low resistivity material 40 is placed on top of a high resistivity material 42 as shown in the electrical distribution structure of the present invention will be examined. For this condition the resistivity of the high resistivity material 42 is several orders of magnitude greater than the low resistivity material 40. In the preferred embodiment the resistance of the high resistivity material 42 is 20 times greater than the resistivity of the low resistivity material 40. For this case, substituting $R_1/20$ for $R_2$ in equation 1 yields equation 5.

$$\frac{1}{R_{AB}} = \frac{1}{3R_1} + \frac{3}{23R_1} + \frac{6}{43R_1} \qquad \text{Equation 5:}$$

Simplifying equation 5 yields equation 6.

$$R_{AB}=(1.3)R_1: \qquad \text{Equation 6}$$

From equations 2, 4 and 6 it can be seen that the electrical distribution structure 30 of the present invention provides a resistance between the main contact point 44 and individual use points 46, 48 that is greater than the case where a uniform ground plane is used represented by equation 4 but less than the case where no ground plane is used represented by equation 2. The electrical distribution structure 30 of the present invention provides a resistance $R_{AB}$ between the main contact point 44 and individual use points 46 and 48 that is sufficiently large to prevent large currents at these use points from varying the voltage at the main contact point 44. Therefore, electrical isolation is provided while at the same time good electrical shielding is provided between electrical conductors 50, 52 and 53.

The electrical distribution structure 30 of the present invention makes use of conductors 50, 52 and 53 which are defined to compensate for both the sheet resistance of the conductors 50, 52 and 53 represented by $R_1$ as well as the resistance due to surrounding conductors coupled by the high resistivity underlying layer 42, represented by the lumped equivalent resistance, $R_2$, in FIG. 7. By defining the conductors to compensate for both the sheet resistance of the low resistivity material 40 and the resistance between neighboring conductors the resistance between the main contact point 44 and each individual use points 46 and 48 can be matched. As discussed previously, there are a number of ways in which the conductor is defined to compensate for these resistances. In the preferred embodiment, the conductor portions are formed of uniform thickness and the width of the conductor varied between the main contact point 44 and the individual use points 46 and 48, as shown in FIG. 2 to compensate for the resistivity of the conductors $R_1$ and the resistivity between neighboring conductors $R_2$. By compensating for resistors $R_1$ and $R_2$ the resistance between the main contact point 46 and 48 compensates for variations in distance between the main contact point and individual use points as well as variations in electric current paths resulting from varying electric potentials.

The electrical distribution structure 30 of the present invention allows closer spacing of electrical conductors than in the previously used electrical distribution structure 70 shown in FIG. 3. In addition, the method for forming the electrical distribution structure 30 of the present invention does as much of the surface area of the passivation layer 72 because the high resistivity material 42 covers a greater portion of the passivation layer 72. By limiting the exposure area of the passivation layer 72, the method of the present invention tends to reduce reliability problems resulting from etch damaging layers beneath the passivation layer 72. Finally, the electrical distribution structure of the present invention provides a relatively high resistance path between individual use points. Providing this high resistance path between use points helps isolate the individual use points from the effects of voltage variations at these use points resulting from large currents of these use points.

What is claimed is:

1. A method for forming a segmented electrical distribution structure comprising:

forming a low resistance conductive layer on a uniform high resistance conductive layer; and masking and etching the low resistance conductive layer to define a main contact point, a plurality of use points and a plurality of conductors with each of the plurality of conductors extending between the main contact point and a corresponding use point of the plurality of use points, each of the plurality of conductors defined in the masking and etching steps have a different conductor size and a different conductor position relative to adjacent conductors to provide equal resistance between the main contact point and each of the plurality of use points.

2. The method of claim 1 wherein the resistance of each conductor is based on a resistance of the low resistance conductive layer and a resistance due to electrical interaction of adjacent conductors through the high resistance conductive layer.

3. The method of claim 1 wherein the conductor size defines a resistance component due to the low resistance conductive layer and the conductor position relative adjacent conductors defines a resistance component due to electrical interaction of adjacent conductors through the high resistance conductive layer.

4. The method of claim 1 wherein the uniform high resistance conductive layer is formed from tantalum and the low resistance conductive layer is formed from gold.

5. The method of claim 1 wherein etching to define a plurality of conductors within the low resistance conductive layer is performed using a wet etch process.

6. The method of claim 1 wherein etching to define the uniform high resistance conductive layer is performed using a dry etch process.

7. The method of claim 1 further including depositing a resistive layer and defining a plurality of heating elements in the resistive layer for vaporizing ink for ejecting ink droplets onto print media with the interconnect structure, each of the plurality of heating elements are electrically connected to each of the plurality of use points.

8. An interconnect structure for electrically connecting a main contact point with a plurality of use points, the interconnect structure comprising:

a uniform high resistance conductive layer;

a low resistance conductive layer formed on the uniform high resistance conductive layer, the low resistance conductive layer defining a main contact point and corresponding first and second use points spaced from the main contact point, the low resistance conductive layer further defining first and second conductors extending between the main contact point and the first and second use points respectfully; and wherein the first conductor has a conductor width that is selected to balance a resistance between the main contact point and the first use point with a resistance between the main contact point and the second use point.

9. The interconnect structure of claim 8 wherein the first conductor width is based on a sheet resistance of the low resistance conductive layer.

10. The interconnect structure of claim 8 wherein the low resistance conductive layer defines a third use point and a third conductor extending between the main contact point and the third use point, the third conductor being disposed adjacent the first conductor, opposite the second conductor, the first conductor having a corresponding conductor width that is based on a resistance between each of the first and third conductors.

11. The interconnect structure of claim 8 wherein the first and second conductors are electrically coupled by a resistance of the high resistance conductive layer and wherein the conductor width of the first conductor is based on the resistance of the high resistance conductive layer.

12. The interconnect structure of claim 8 wherein the high resistance conductive layer has a sheet resistance associated therewith that is 20 times greater than a sheet resistance associated with the low resistance conductive layer.

13. The interconnect structure of claim 8 further including a resistive layer defining a first and second heating element in the resistive layer for vaporizing ink for ejecting ink droplets onto print media, the first and second heating elements being electrically connected to the first and second use points, respectively.

14. An electrical interconnect structure for electrically connecting a main contact point with a plurality of use points, the interconnect structure comprising:

a uniform high resistance conductive layer;

a low resistance conductive layer formed on the uniform high resistance conductive layer, the low resistance conductive layer defining a main contact point and corresponding first and second use points spaced from the main contact point, the low resistance conductive layer further defining first and second conductors each extending between the main contact point and the first and second use points, respectively; and wherein the first and second conductor are so disposed and arranged on the high resistance conductive layer to balance a resistance between the main contact point and the first use point with a resistance between the main contact point and the second use point.

15. The electrical interconnect structure of claim 14 wherein the low resistance conductive layer alone has a resistance imbalance between resistance's between the main contact point and each of the first and second use points and wherein the first and second conductor are so disposed and arranged on the high resistance conductive layer to provide an electrical interaction through the high resistance conductive layer to compensate for the resistance imbalance associated with the low resistance conductive layer alone.

16. The electrical interconnect structure of claim 14 wherein a conductor width associated with one of the first and second conductors is dimension to balance the resistance between the main contact point and the first use point with the resistance between the main contact point and the second use point.

17. The electrical interconnect structure of claim 15 wherein the conductor spacing between the first and second conductors is selected to balance the resistance between the main contact point and the first use point with the resistance between the main contact point and the second use point.

18. An interconnect structure for electrically connecting a main contact point with a plurality of use points, the interconnect structure comprising:

a uniform high resistance conductive layer;

a low resistance conductive layer formed on the uniform high resistance conductive layer, the low resistance conductive layer defining a main contact point and corresponding first and second use points spaced from the main contact point, the low resistance conductive layer further defining first and second conductors extending between the main contact point and the first and second use points, respectfully; and wherein the first conductor is disposed and arranged relative the second conductor to electrically interact with the second conductor to produce a desired resistance between the main contact point and the second use point to balance a resistance between the main contact point and the second use point.

19. The interconnect structure of claim 18 further including a resistive layer defining a first and second heating element for vaporizing ink for ejecting ink droplets onto print media, the first and second heating elements being electrically connected to the first and second use points, respectively.

20. The interconnect structure of claim 18 wherein the first conductor and second conductor are so disposed and arranged so that the resistance between the main contact point and the second use point is substantially the same as the resistance between the main contact point and the first use point.

21. The interconnect structure of claim 18 wherein the low resistance conductive layer defines a third use point and a third conductor extending between the main contact point and the third use point, the third conductor being disposed between the first conductor and the second conductor, opposite the second conductor, the third conductor having a selected resistance between the main contact point and the third use point that is based a conductivity of the low resistance layer and proximity of each of the first and second conductors.

22. The interconnect structure of claim 18 wherein the first and second conductors are electrically coupled through the high resistance conductive layer.

23. The interconnect structure of claim 18 wherein the high resistance conductive layer has a sheet resistance associated therewith that is 20 times greater than a sheet resistance associated with the low resistance conductive layer.

* * * * *